US005227847A

United States Patent [19]

Motohashi et al.

[11] Patent Number: 5,227,847

[45] Date of Patent: Jul. 13, 1993

[54] IMAGE FORMING EQUIPMENT WITH SUPPLEMENTAL DEVELOPER DETECTING DEVICE

[75] Inventors: Hiroomi Motohashi, Tokyo; Shunji Katoh, Sagamihara, both of Japan

[73] Assignee: Ricoh Company, Ltd., Tokyo, Japan

[21] Appl. No.: 749,328

[22] Filed: Aug. 23, 1991

[30] Foreign Application Priority Data

Aug. 29, 1990 [JP] Japan ..... 2-229459

[51] Int. Cl.[5] ..... G03G 15/08

[52] U.S. Cl. ..... 355/245; 355/246; 355/296

[58] Field of Search ..... 355/245, 260, 246, 209, 355/296, 205-207; 118/653, 689, 652, 694, 693; 222/DIG. 1

[56] References Cited

U.S. PATENT DOCUMENTS

| | | | |
|---|---|---|---|
| 4,669,856 | 6/1987 | Yamada | 355/246 X |
| 4,742,372 | 5/1988 | Takahashi | 118/689 X |
| 4,934,314 | 6/1990 | Ideyama | 118/689 |
| 4,951,091 | 8/1990 | Nawata . | |
| 4,952,976 | 8/1990 | Katoh et al. | 355/246 X |
| 4,999,676 | 3/1991 | Mouri | 355/246 |
| 5,035,198 | 7/1991 | Niito | 355/246 X |
| 5,105,218 | 4/1992 | Ikeda et al. | 355/206 |

FOREIGN PATENT DOCUMENTS

| | | |
|---|---|---|
| 3918960 | 12/1989 | Fed. Rep. of Germany . |
| 0030778 | 2/1983 | Japan . |
| 0076864 | 5/1983 | Japan . |
| 60-15668 | 1/1985 | Japan . |
| 0159171 | 7/1987 | Japan . |
| 0043182 | 2/1988 | Japan . |
| 0004787 | 1/1989 | Japan . |

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

Image forming equipment having a developing device for developing a latent image electrostatically formed on an image carrier by a developer, and a cleaning device for removing the developer remaining on the image carrier and collecting it in a collecting section. The equipment determines whether or not the developer collected in the collecting section has reached a predetermined amount by determining whether or not a developer has been supplemented to the developing device a predetermined number of times. The number of times that a developer is supplemented to the developing device is counted on the basis of the output of a supplement detector which determines whether or not a developer has been supplemented. The supplement detector determines that developer has been supplied only when a predetermined number of copies have been made after a toner low/empty signal is indicated or the toner concentration is detected to increase after the toner low/empty signal is indicated.

5 Claims, 7 Drawing Sheets

START
COPY BUTTON ON?
1
NO
YES
PRODUCE SINGLE COPY
2
INCREMENT COPY COUNTER BY 1
3
P SENSOR CHECK
4
TONER SUPPLY
5
TONER END ?
6
YES
NO
INHIBIT COPYING
9

IMAGE FORMING EQUIPMENT WITH SUPPLEMENTAL DEVELOPER DETECTING DEVICE

BACKGROUND OF THE INVENTION

The present invention relates to image forming equipment such as an electrophotographic or electrostatic copier, facsimile transceiver or printer and, more particularly, to image forming equipment of the type having a cleaning device which removes a developer from a photoconductive element after image transfer and collects it in a collecting section thereof.

Image forming equipment of the type described develops a latent image electrostatically formed on an image carrier by a developing device, transfers the developed image to a recording medium, and then removes the developer remaining on the image carrier by a cleaning device and collects it in a collecting section of the cleaning device. The equipment determines whether or not the developer collected in the collecting section has reached a predetermined amount by determining whether or not a fresh developer has been supplemented to the developing device a predetermined number of times. This stems from the fact that when the equipment repeats an image forming cycle with a single supplement of developer, the amount of developer to be collected in the collecting section is substantially fixed by the type of the equipment and, therefore, the developer collected in the collecting section reaches a predetermined amount when a developer is supplemented a particular number of times.

Japanese Patent Publication No. 40990/1989, for example, discloses equipment having a concentration sensor responsive to the decrease in toner concentration beyond a predetermined one. On such a decrease in toner concentration, a toner supply device for feeding a toner to a developing device is driven. If the toner concentration does not increase to the predetermined concentration within a predetermined period of time despite the feed of toner, the equipment turns on an alarm lamp to urge the operator to supplement a toner to a hopper thereof by determining that the hopper has run out of toner. At the same time, the equipment adds "1" to a memory which counts the number of times that a toner is supplemented. Thereafter, the memory is incremented by "1" every time a toner is supplemented to the hopper, i.e., every time the alarm lamp is turned on. When a toner is supplemented a predetermined number of times, meaning that a predetermined amount of toner is collected in a filter bag constituting the collecting section, a lamp for informing the operator of the time for inspecting the equipment is turned on.

The conventional scheme described above has a drawback left unsolved, as follows. The memory for counting the number of times of toner supply is incremented by "1" at the instant when the alarm lamp for urging the operator to supplement a toner to the hopper is turned on due to the toner concentration having failed to increase within a predetermined period of time, as stated above. It follows that even when a toner is actually not supplemented, it is determined that a toner has been supplied once. The conventional equipment, therefore, cannot count the number of times of toner supply with accuracy.

SUMMARY OF THE INVENTION

It is, therefore, an object of the present invention to provide image forming equipment capable of counting the number of times of toner supply to a developing device thereof accurately.

It is another object of the present invention to provide generally improved image forming equipment.

In accordance with the present invention, image forming equipment having a developing device for developing a latent image electrostatically formed on an image carrier by a developer, and a cleaning device for removing the developer remaining on the image carrier and collecting it in a collecting section thereof, and determining whether or not the developer collected in the collecting section has reached a predetermined amount by determining whether or not a developer has been supplemented to the developing device a predetermined number of times comprises a supplement detector for determining whether or not a developer has been supplemented to the developing device, and a supplement counter for counting the number of times that a developer is supplemented to the developing device on the basis of the output of the supplement detector.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
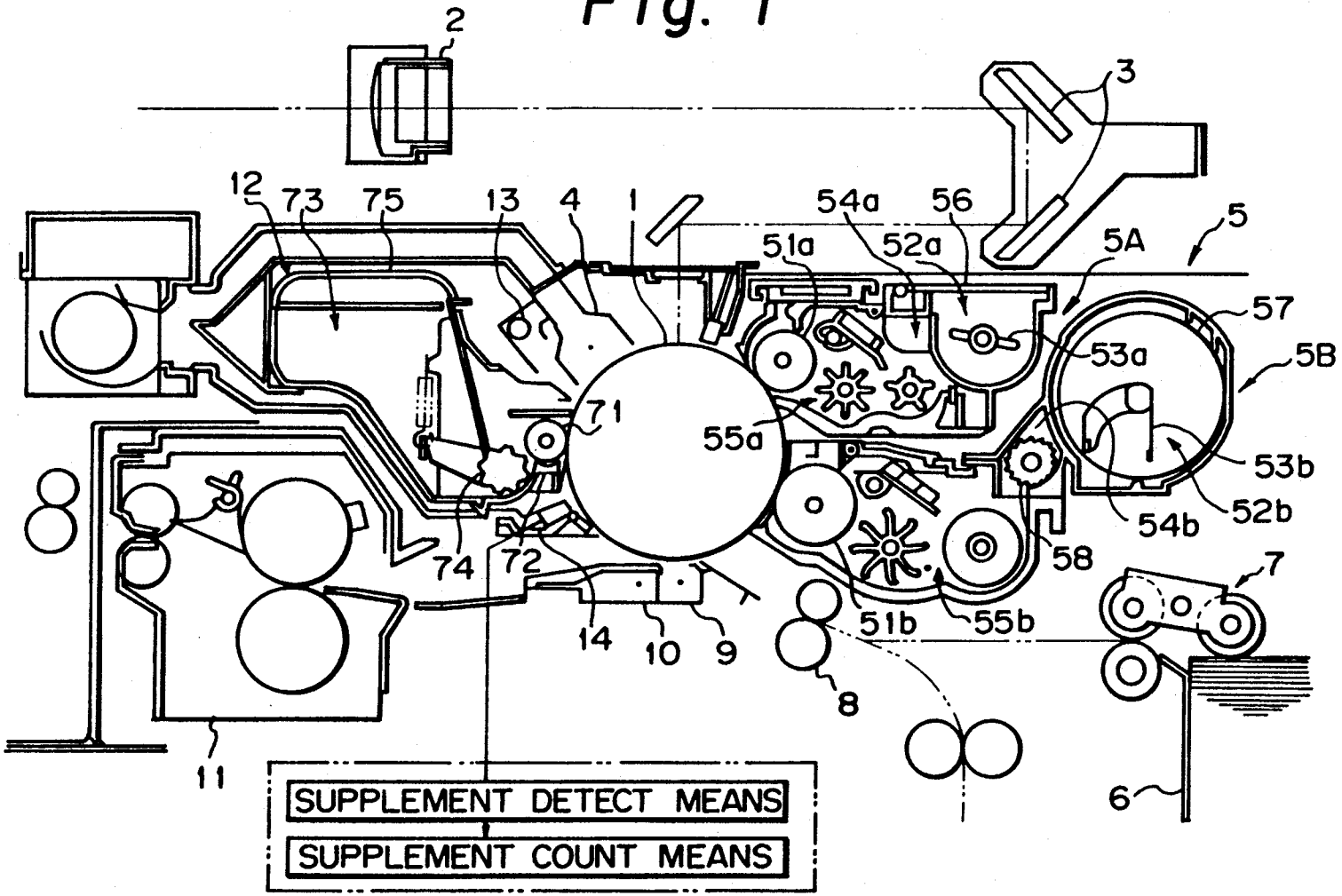
FIG. 1 shows image forming equipment embodying the present invention and implemented as a copier.

Referring to FIG. 1 of the drawings, image forming equipment embodying the present invention is shown and implemented as an electrophotographic copier using a dry two-component developer. When a copy start button, not shown, provided on the copier is pressed, a photoconductive drum 1 starts rotating clockwise. At the same time, a light source, not shown, is turned on, and a drive source, not shown, drives optics made up of the optics, a lens 2 and mirrors 3 to scan a document laid on a glass platen, not shown. As a result, a latent image representative of the document is electrostatically formed on a photoconductive drum 1 having been uniformly charged by a main charger 4. A developing device 5 develops the latent image to produce a corresponding toner image on the drum 1. A recording medium in the form of a sheet is fed out from a cassette 6 by a sheet feeding device 7 and then driven toward the drum 1 by a register roller 8 at a predetermined timing such that it meets the toner image on the drum 1. A transfer charger 9 transfers the toner image from the drum 1 to the sheet, and then a discharger 10 separates the sheet from the drum 1. Thereafter, the sheet carrying the toner image thereon is routed through a fixing device to have the toner image fixed thereon. Finally, the sheet or copy is driven out to a tray, not shown. A cleaning device 12 removes the toner remaining on the drum 1 after the image transfer. A lamp 13 dissipates the charge remaining on the drum 1 having been cleaned by the cleaning device 12 so as to prepare the drum 1 for the next charging.

In the illustrative embodiment, the developing device 5 has a color developing unit 5A and a black developing unit 5B which store a color toner and a black toner, respectively. The color developing unit 5A has a storing section 52*a* storing a color toner and a hopper section 54*a* to which a supply bar 53*a* supplies the toner from the storing section 52*a*. A supply roller, not shown, is disposed in a lower portion of the hopper section 54*a* and is rotated to supply the toner to a developing chamber 55*a* by toner supply control which will be described. As a result, the toner is mixed with carrier particles and agitated in the developing chamber 55*a* and then deposited on the surface of a developing roller 51*a* as a developer. As the developing roller 51*a* is rotated, the developer is brought into contact with the drum 1 to develop the latent image. A lid 56 covering the storing section 52*a* is openable. After the color developing unit 5A has been removed from the copier, the lid 56 may be opened to supplement a predetermined amount of color toner to the developing unit 5A. In the black developing unit 5B, a toner container 57 filled with a black toner is removably received in a loading section 52*b*. A supply bar 53*b* supplies the black toner from the container 57 to a hopper section 54*b*. A supply roller 58 is disposed in a lower portion of the hopper section 54*b* and is rotated to supply the toner to a developing chamber 55*b* by toner supply control which will be described. As a result, the toner is mixed with carrier particles and agitated in the developing chamber 55*b* and then deposited on the surface of a developing roller 51*b* as a developer. As the developing roller 51*b* is rotated, the developer is brought into contact with the drum 1 to develop the latent image. The toner container 57 is put in the loading section 52*b* while the developing unit 5B is set in the copier.

In this embodiment, a reference density plate is provided at one side edge of a glass platen, not shown, which is to be loaded with a document. While a document to be copied is scanned, a latent image representative of the reference density plate is electrostatically formed on the drum 1 outside of a document image forming area by the optics. The developing device 5 develops this latent image. A photosensor 14 is made up of a light emitting element and a light-sensitive element and senses the density of the toner image representative of the reference density plate (referred to as a reference pattern hereinafter). The rotation of the supply roller 58 is controlled on the basis of the sensed density of the reference pattern, so that a predetermined toner concentration may be maintained. Specifically, the positions of the drum 1 preceding and succeeding the reference pattern are erased to sense the surface of the drum 1 itself where the toner is not deposited by the photosensor 14. The resulting output VG of the photosensor 14 (substantially constant and 4.0 volts, for example) and the output VP of the same representative of the reference pattern are compared to determine the toner concentration. The sensor output VP is usually about 0.5 volt, for example, when the toner concentration is adequate. As the toner concentration of the developer decreases, the density of the reference pattern formed on the drum 1 also decreases with the result that the sensor output VP increases. Conversely, as the toner concentration increases, the sensor output VP decreases. The toner concentration is sensed every ten copies. When such an operation is not performed, the whole latent image representative of the reference pattern is erased to save the toner and to reduce the load on the cleaning device 12.

A toner supply signal for rotating the supply roller 58 is generated to supply the toner when, for example, the following relation holds:

$$VP-1/8VG>0$$

Any one of three successive amounts of toner supply per copying operation, or copying cycle, is selected on the basis of the ratio of the sensor output VP to the sensor output VG. The toner is supplied in such a selected amount every copying cycle up to the time when the toner concentration is to be sensed again.

The output of the photosensor 14 is also used to detect a toner end condition wherein the hopper has run out of toner. Specifically, when the ratio VP/VG greater than a predetermined value (e.g. greater than 0.9/4.0) is detected five consecutive times (corresponding to fifty copies), it is determined that no toner is left in the hopper. As stated above, since the photosensor 14 senses the toner concentration every ten copies, the decision on the toner end condition is repeated at intervals and not constantly effected. When the toner end condition is detected, the copier is inhibited from operating, and a toner end display means or alarm means is turned on. The inhibition of copying operation is cancelled when the operator opens and closes the front cover of the copier, whereby the copying operation is resumed. At this instant, while the operator usually supplements a fresh toner, it sometimes occurs that the operator simply restarts the copying operation without supplying a toner. Then, a toner end condition will be detected again afterwards in response to the output of the photosensor 14, inhibiting the operation of the copier in the above-stated manner.

In the illustrative embodiment, the cleaning device 12 has a fur brush 71 rotatable in contact with the drum 1, a beating section 72 for beating the toner off the fur brush 71, and a collecting roller 74 for collecting the toner so removed by the beating section 72 in a collecting chamber 73. The amount of toner which can be collected in the chamber 73 is determined by the volume of the chamber 73. If more than such a limited amount of toner is collected in the chamber 73, it is apt to leak to the outside between a lid 75 and the wall of the chamber 73. Moreover, the collecting roller 74 is apt to fail to collect such an amount of toner and allow it to stay therearound. This part of toner will overflow the cleaning device 12 to the interior of the copier through an opening of the device 12 in which the fur brush 71 is disposed.

Generally, since the image transfer ratio by the image transfer device 9 is substantially constant (e.g. 80 percent to 85 percent), a given part (e.g. 15 percent to 20 percent) of the total amount of toner used is collected in the chamber 73. In light of this, whether or not the toner collected in the chamber 73 has reached the predetermined amount is determined on the basis of whether or not the toner has been supplemented to the developing device 5 a predetermined number of times. If the toner has been supplemented a predetermined number of times, alarm means in the form of an overflow indicator is turned on. To count the number of times that the toner is supplemented accurately, the embodiment uses a copy counter, or copying cycle counting means, which counts the number of times that the copying cycle is effected after the inhibition of the copier has been cancelled by the opening and closing of the front cover. The embodiment determines whether or not the toner has been supplemented on the basis of whether or not the count of the copy counter is coincident with a predetermined count.

Even when the operator having noticed the turn-on of the toner end indicator opens and closes the front cover to cancel the inhibition of the copier, it does not always mean that the operator has actually supplemented a toner to the copier. On the other hand, if the operator has supplemented a toner, the toner end condition will not be detected by the first toner end detection after the opening and closing of the front cover, allowing the copying cycle to be repeated. Conversely, if the operator has not supplemented a toner, the toner end condition will be detected by the first toner end detection and, therefore, the copier will be inhibited from repeating the copying cycle. It is, therefore, possible to determine whether or not a toner has been supplemented by determining whether or not the copying cycle has been repeated a predetermined number of times without the toner end condition detected after the cancellation of the inhibition of the copier.

That the copier has run out of toner is determined when the ratio VP/VG greater than a predetermined value is detected five consecutive times (corresponding to fifty copies), as stated earlier. The embodiment, therefore, uses fifty consecutive times of a copying cycle as the above-mentioned predetermined number of times, i.e., the set count with which the count of the copy counter should be compared.

Figures 2, 2A, 2B, 2C:
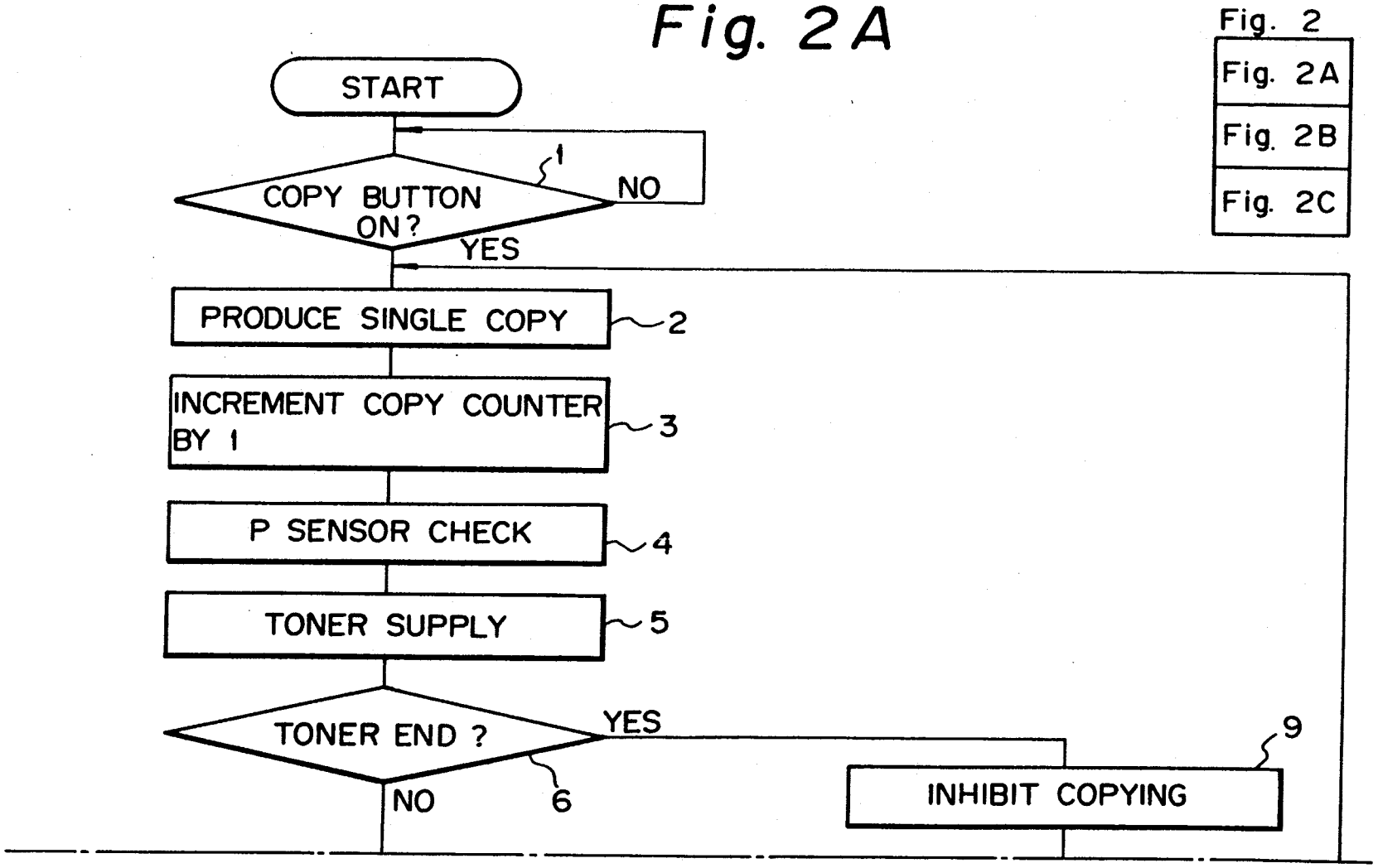
FIG. 2 is a flowchart demonstrating a specific operation of the embodiment for detecting the overflow of a collected toner.
Figure 2B:
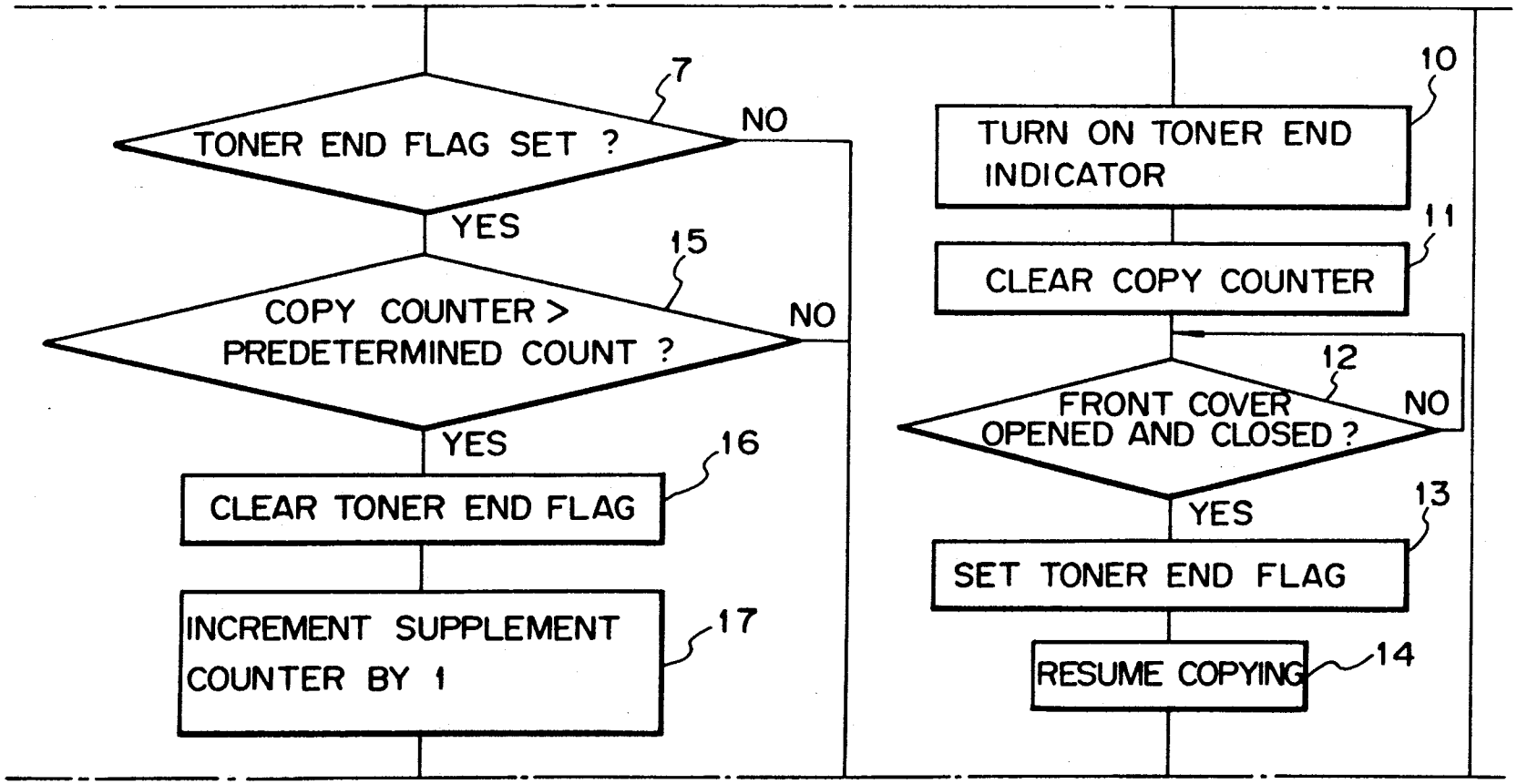
Figure 2C:
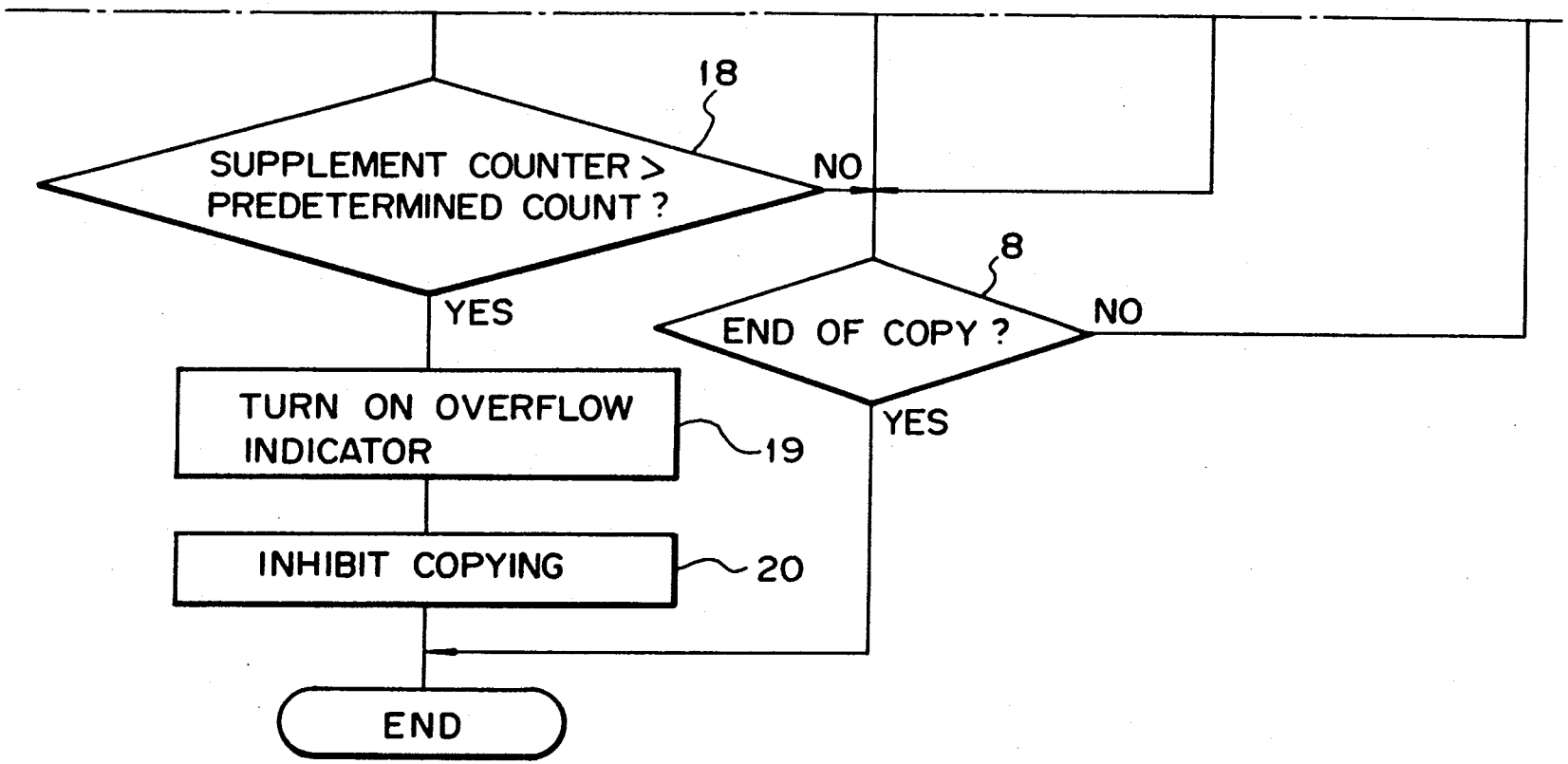

In operation, as shown in FIG. 2, the program waits until the copy start button has been turned on (step 1). On the turn-on of the copy start button, a copying cycle is effected once to produce a single copy (step 2), and then the copy counter is incremented (step 3). The copy counter is backed up by a battery to hold the content thereof. The step 3 is followed by a photosensor (or P sensor as sometimes referred to hereinafter) check subroutine. In this subroutine, the outputs VG and VP of the photosensor 14 are read every ten times of copying cycle to update a register which stores information on whether or not a toner should be supplied and the amount of toner supply. At the same time, whether or not the ratio VP/VG is greater than the predetermined value is determined, and a counter for counting the number of times that a ratio VP/VG greater than the predetermined value occurs continuously (referred to as a toner end counter hereinafter) is updated. Specifically, when the ratio VP/VG is greater than the predetermined value, the toner end counter is incremented; if otherwise, the toner end counter is cleared. Subsequently, a toner supply subroutine (step 5) is executed in which the supply roller is driven, if necessary, by referencing the information having been stored in the previously mentioned register.

In a step 6, whether or not the toner end counter has reached "5", i.e., whether the toner end condition has occurred is determined. If the answer of the step 6 is negative, whether or not a toner end flag is set is determined (see step 13). If the toner end flag is not set, the program checks, for example, the set number of copies to see if the copying operation as ended (step 8). If the answer of the step 8 is negative, the program returns to the step 2. As the copying cycle is repeated until the hopper has run out of toner (Y, step 6), the copier is disabled (step 9) while the toner end indicator is turned on with the toner end counter cleared (step 10). Then, the copy counter is cleared (step 11). Thereafter, the program awaits the opening and closing of the front cover of the copier (step 12). On the opening and closing of the front cover, the toner end flag is set (step 13), the disabled or inhibition condition of the copier is cancelled, i.e., the copying operation is resumed (step 14), and then whether or not the copying operation has ended is determined (step 8). The toner end flag, like the copy counter, is backed up by a battery to hold the content thereof.

Thereafter, the copy counter is sequentially incremented (step 3) to count the number of times that the copying cycle is repeated after the cancellation of the inhibition of the copier. This is followed by the sequence of steps 3, 5 and 6. In the subsequent step 7, since the toner end flag has already been set in the step 13, it is followed by a step 15 for determining whether or not the copy counter has reached the set number of copies. If the answer of the step 15 is negative, the step 8 is executed to see if the copying operation has ended.

The procedure described so far is repeated until the answer of the step 6 changes from negative to positive, meaning that the toner end counter has reached "5", or until the answer of the step 15 changes from negative to positive, meaning that the set number of copies has been reached. If a fresh toner has not been supplemented when the front cover has been opened and closed, the steps 1–7, 15 and 8 are repeated with the toner end counter being incremented every ten copying cycles in the step 4 (P sensor check). On the increase of the toner end counter to "5", the toner is determined to have ended (Y, step 6), followed by the steps 9–14. Here, the set number with which the content of the copy counter should be compared is selected to be greater than the number of copying cycles to be performed until a ratio VP/VG greater than the predetermined value has occurred five consecutive times (corresponding to fifty copies). Therefore, the program is prevented from determining that the content of the copy counter has exceeded the set number (set 15) before it determines that the toner has ended (step 6).

Conversely, if a toner has been supplemented at the time of opening and closing of the front cover, the steps 1–7, 15 and 8 are repeated with the copy counter being sequentially incremented in the step 3 and with the toner end counter remaining "0". As the copy counter exceeds the set number, the program advances from the step 15 to the step 16 to reset the toner end flag, then to the step 17 to increment a counter for counting the number of times that a toner is supplemented (referred to as a supplement counter hereinafter), and then to the step 18 for determining whether or not the content of the supplement counter is great than a predetermined value. If the answer of the step 18 is negative, the step 8 is executed to see if the copying operation has ended. The toner end flag has already been reset in the step 16, as stated earlier. Hence, in the subsequent copying cycles, the steps 1–7 and 8 are repeated until the answer of the step 6 changes from negative to positive. On the increment of the toner end counter to "5", i.e., when the answer of the step 6 is positive, the steps 9–14 are repeated.

Thereafter, in the copying cycles which follow the toner end detection (steps 14), wherein or not a toner has been supplemented is determined on the basis of whether or not the copy counter has exceeded the set number. Every time the copy counter exceeds the set number, the supplement counter is incremented. When the supplement counter exceeds a predetermined number as determined in a step 18, the overflow indicator is turned on (step 19), and then the copier is inhibited from operating (step 20).

As stated above, the copy counter is cleared in the event when a toner end condition is detected and incremented every time the copying cycle is effected, thereby counting the number of times that the copying cycle is effected after the detection of a toner end condition. Based on whether or not the copy counter exceeds a predetermined number, the embodiment determines whether or not a toner has been supplemented by the operator. This is successful in counting the number of times that a toner is supplemented with accuracy.

The above embodiment has been shown and described as, on detecting a toner end condition, turning on the toner end indicator. or alarm means and inhibiting the copier from operating. Alternatively, an arrangement may be made such that when the toner remaining in the hopper is low alarm means implemented as a near end indicator is turned on and, when the front cover is not opened until a predetermined number of copies available with the remaining toner have been produced, the copier is disabled after the production of such copies. In this case, whether or not a toner has been actually supplemented after the near end indication is determined on the basis of whether or not after the detection of the near end condition near-end detecting means again determines that the toner remaining in the hopper is short while the copying cycle is repeated a predetermined number of times.

Further, assume that the copier has both of the toner end sensing means and the near end sensing means and, on detecting a near end condition, turns on the near end indicator. In such as a case, whether or not a toner has been supplemented may be determined on the basis of whether or not the toner end sensing means determines that the hopper has run out of toner while the copying cycle is repeated a predetermined number of times.

Figure 3A:
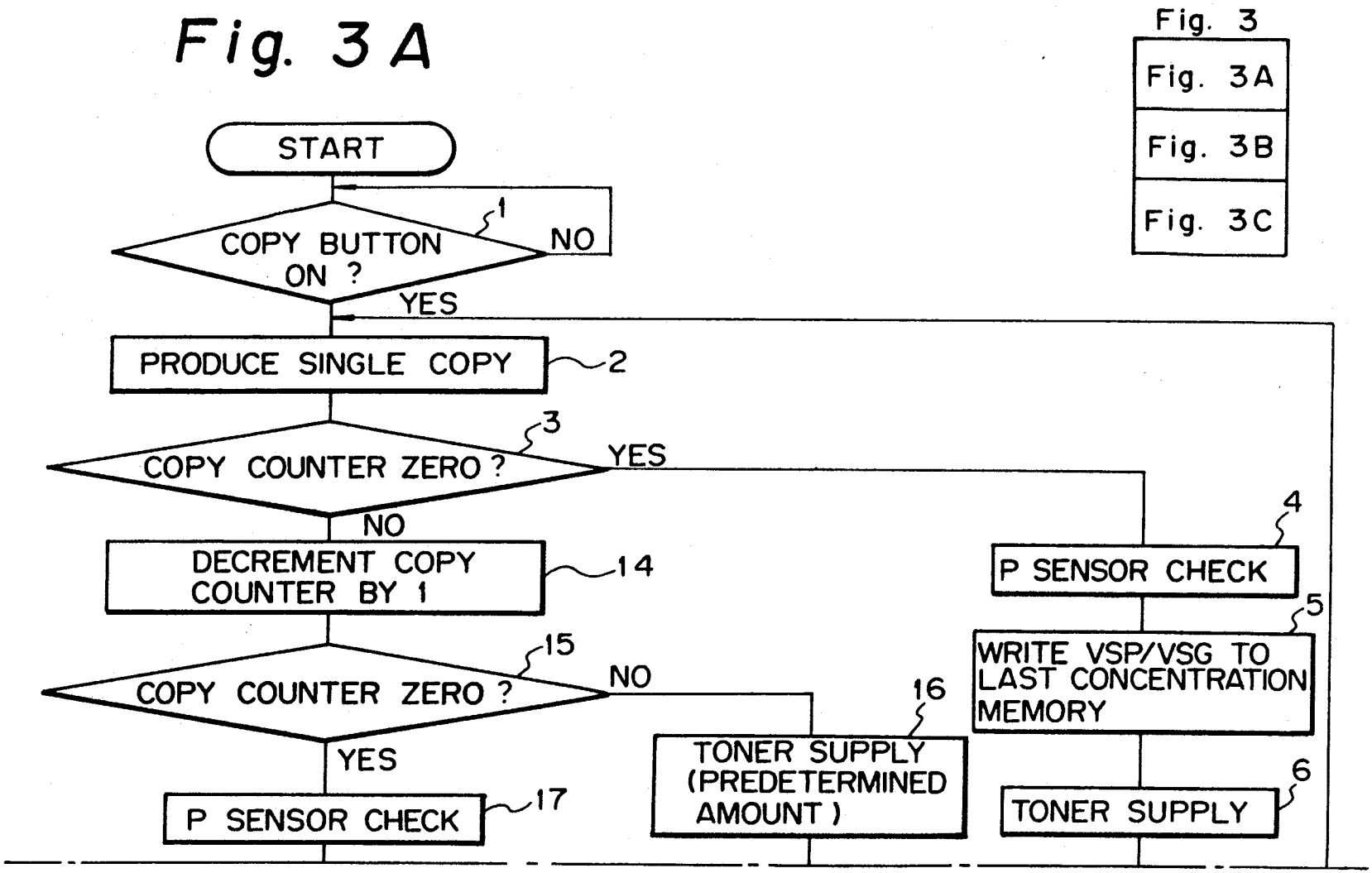
FIG. 3 is a flowchart representative of an alternative embodiment of the present invention.
Figure 3B:
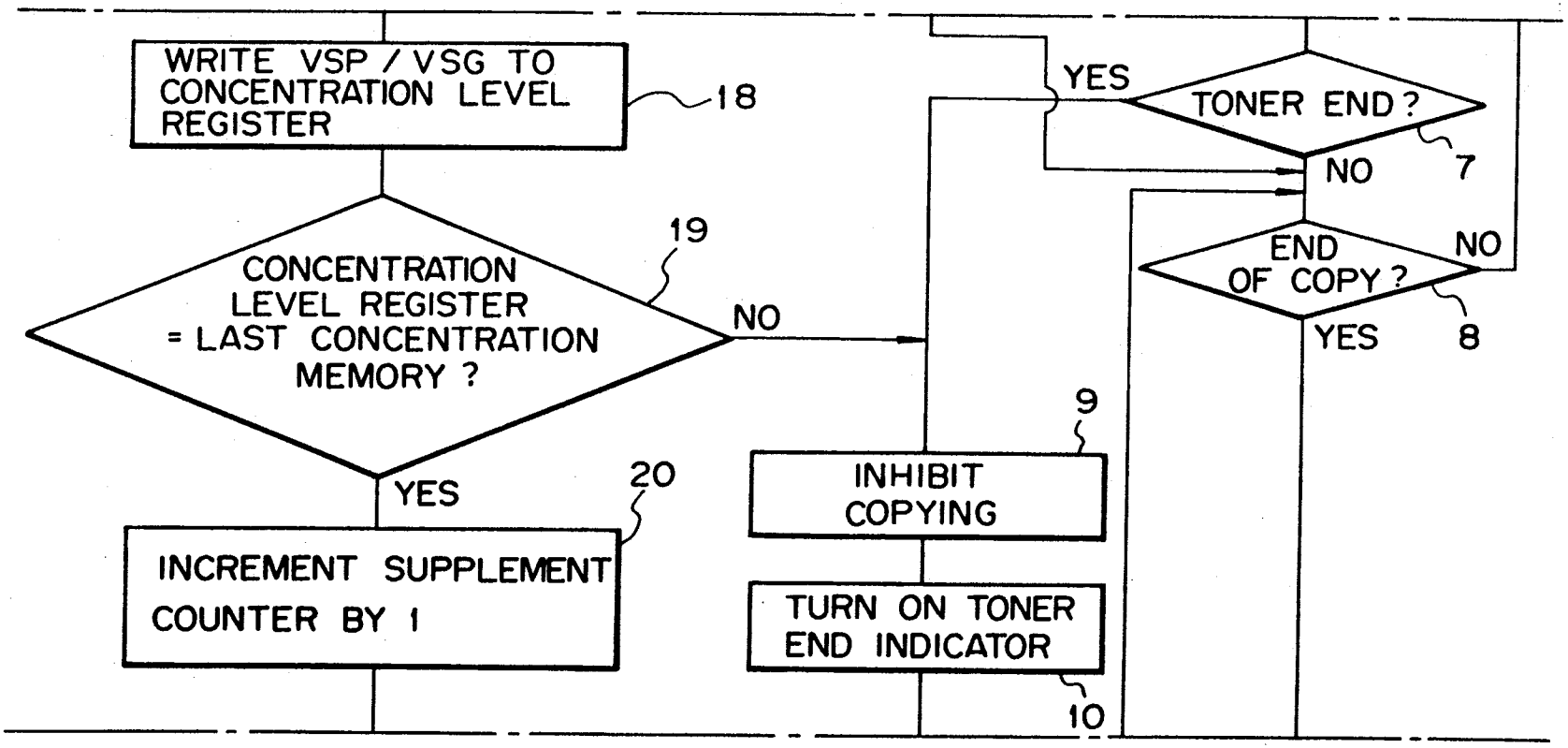
Figure 3C:
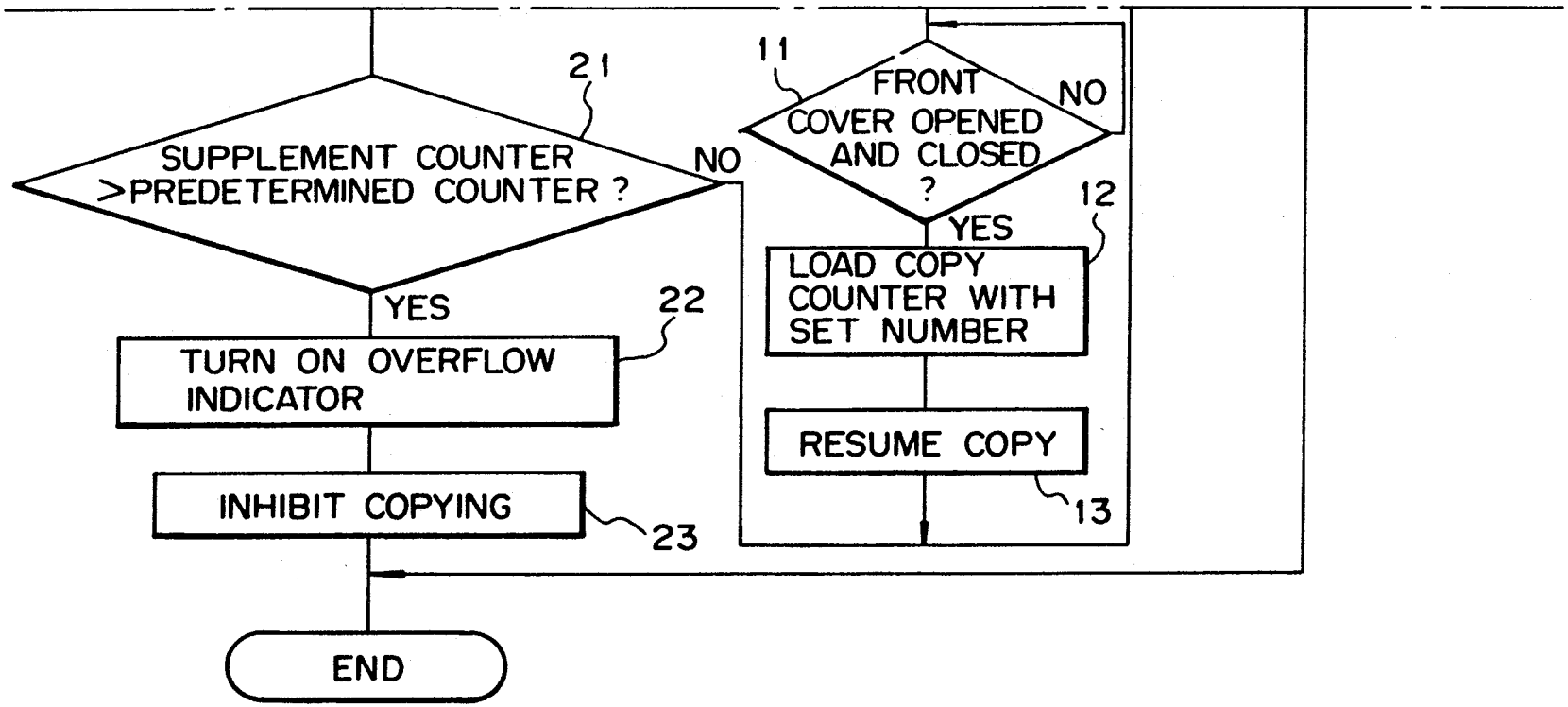

Referring to FIG. 3, an alternative embodiment of the present invention will be described which is also practicable with the construction shown in FIG. 1. This embodiment is essentially identical with the previous embodiment regarding toner concentration sensing, control over the rotation of the supply roller based on the sensed toner concentration, and toner end detection control.

Briefly, to count the number of times that a toner is supplemented with accuracy, this embodiment has toner end detecting means for determining that the developing device has run out of toner, sensing means responsive to the toner concentration of the developer, and decision means responsive to the output of the sensing means for determining whether or not the toner concentration has increased after a toner end condition has been detected. As stated earlier, that the operator has opened and closed the front cover to cancel the inhibition of the copier after the turn-on of the toner end indicator does not always mean that the operator has actually supplied a toner. On the other hand, if the operator has supplied a toner, it is fed to the developing chamber by the concentration sensing and toner supply control which follows the opening and closing of the front cover, increasing the toner concentration in the chamber. If the operator has not supplemented a toner, the toner concentration in the developing chamber does not increase despite the toner concentration and toner supply control. It follows that whether or not a toner has been supplemented can be determined on the basis of whether or not the toner concentration has increased after the opening and closing of the front cover, i.e., after the cancellation of the inhibition of the copier.

In FIG. 3, the program first awaits the turn-on of the copy start button (step 1). On the turn-on of the copy start button, the copying cycle is effected once to produce a single copy (step 2), and then whether or not the copy counter is "0" is determined (step 3). If the answer of the step 3 is positive, the operation is transferred to a step 4. Here, the copy counter is a counter to be loaded with the set value after the detection of a toner end condition (see step 12) and is backed up by a battery to hold the content thereof. In the step 4, a photosensor (P sensor) check subroutine is executed. In this subroutine, the outputs VG and VP of the photosensor 14 are read every time the copying cycle is repeated ten times so as to update the register which stores information on whether or not toner supply is necessary and the amount of toner supply. At the same time, whether or not the ratio VP/VG is greater than a predetermined value is determined so as to update the toner end counter in the same manner as in the previous embodiment. Subsequently, the ratio VP/VG determined in the step 4 is written to a last concentration level memory (step 5), and then a toner supply subroutine is executed (step 6). In the toner supply subroutine, the supply roller is driven, if necessary, on the basis of the contents of the above-mentioned register.

In the subsequent step 7, the toner end counter is checked to see if the toner has ended, i.e., if the counter has reached "5". If the answer of the step 7 is negative, whether or not the copying operation has ended is determined in terms of, for example, the set number of copies (step 8). If the answer of the step 8 is negative, the program returns to the step 2. As the hopper runs out of the toner due to the repetitive copying cycle, a toner end condition is detected (step 7). Then, the copier is inhibited from operating (step 9), the toner end indicator is turned on (step 10), and the program awaits the opening and closing of the front cover (step 11). On the opening and closing of the front cover, the copy counter is loaded with the set number (step 12), the inhibition of the copier is cancelled (copying operation is resumed) (step 13), and then whether or not the copying operation has ended is determined (step 8). In the subsequent copying cycle, the operation is transferred from the step 3 to a step 14 since the copy counter has been loaded with the set number in the step 12. After the copy counter has been decremented in the step 14, whether or not it is "0" is determined (step 15). If the copy counter is not "0", the toner is fed in a predetermined amount (step 16), and then whether or not the copying operation has ended is determined (step 8).

The above-stead steps 1–3, 14–16 and 8 are repeated until the copy counter reaches "0" (step 15). If the operator has not supplemented a toner when the front cover was opened and closed, the toner concentration in the developing chamber sequentially decreases from the concentration sensed at the time of toner end detection (written to the last concentration level memory in the step 5) since no toner is left in the hopper. Conversely, if the operator has supplemented a toner, the toner concentration sequentially increases from the above-mentioned concentration since the toner is fed from the hopper to the developing chamber in the step 16. As the copy counter is decremented (step 14) in the predetermined copying cycle as counted from the time of toner end detection, it reaches "0" and, therefore, the operation is transferred from the step 15 to a step 17.

In the step 17, a P sensor check subroutine is effected as in the step 4. The step 17 differs from the step 4 in that it effects the subroutine of interest every time the copying cycle is performed. In a step 18, the ratio VP/VG which is the output of the photosensor 14 is written to a concentration level register. Then, whether or not the ratio VP/VG of interest is smaller than the ratio VP/VG read out of the last concentration memory (step 19). Assuming that no toner was supplemented when the cover was opened and closed, then the toner concentration in the chamber 55 is lower than the concentration sensed at the time of toner end detection and, therefore, the ratio VP/VG of interest is not smaller than the ratio VP/VG read out of the last concentration memory. Hence, the operation is transferred from the step 19 to the steps 9–13.

Assuming that a toner was supplemented when the front cover was opened and closed, the toner concentration in the chamber 55 is higher than the concentration sensed at the time of toner end detection and, therefore, the ratio VP/VG is greater than the ratio VP/VG read out of the last concentration memory. As a result, the program advances to a step 20 for incrementing the supplement counter which counts the number of times that a toner is supplemented. Then, whether or not the supplement counter has exceeded a predetermined number (step 21) is determined and, if the answer is negative, the step 8 is executed. Since the copy counter has already been decremented to "0" in the step 14, the steps 1–8 are repeated in the following copying cycles until the supplied toner has been fully consumed, i.e., until the answer of the step 7 changes from negative to positive.

Thereafter, in the predetermined copying cycle after the sequence of steps 9–13 have been executed, whether or not a toner has been supplemented is determined on the basis of whether or not the ratio VP/VG written to the concentration level register is smaller than the ratio VP/VG read out of the last concentration memory. Every time, the ratio VP/VG becomes smaller than the last ratio VP/VG, the supplement counter is incremented. When the supplement counter exceeds a predetermined number of times as determined in a step 21, the toner overflow indicator is turned on (step 22) and the copier is disabled (step 23).

As stated above, this embodiment compares the toner concentration sensed at the time when a toner end condition was detected and the subsequent toner concentration and determines whether or not the latter is higher than the former to see if a toner was supplied. The embodiment, therefore, counts the number of times of toner supplement with accuracy.

The embodiment uses the toner concentration associated with a particular copy produced after the detection of a toner end condition as a concentration to be compared with a concentration sensed at the time of toner end detection. The comparison, therefore, can be effected at a stage wherein the toner concentration has been surely increased due to the feed of a toner to the developing chamber 55.

While the embodiment compares the toner concentration sensed at the time of toner end detection and a single toner concentration sensed thereafter, the toner concentration may be sensed twice after the toner end detection and the sensed concentrations may be compared to determine whether or not the concentration has increased. Further, the concentration may be sensed three times or more after the toner end detection, and the sensed concentrations may be differentiated for the decision.

The toner end indicator may be replaced with a near end indicator which is responsive to the short amount of toner remaining in the hopper. Then, whether or not a toner has been actually supplemented after the detection of a near end condition may be determined on the basis of whether or not the toner concentration has increased after the production of a given number of copies available with the remaining developer.

While both of the embodiments shown and described inhibit the copier from operating on the detection of a toner end condition, they may simply turn on the toner end indicator and does not have to disable the copier.

In the illustrative embodiments, the toner overflow indicator is turned on independently of the toner end indicator. Alternatively, the overflow indicator may be turned on at the same time as the first turn-on of the toner end indicator after the supplement counter has reached a set number. This allows the operator to supplement a toner and deal with the full collecting chamber at the same time. In such a case, the set number to be compared with the content of the supplement counter will be selected by taking account of the amount of toner collection up to the first toner end detection after the supplement counter has reached a predetermined number.

Although the embodiments use toner concentration sensing means of the type sensing the amount of toner deposited on the photoconductive drum, they are similarly practicable with sensing means which are directly responsive to the concentration information in the developing chamber 55 (e.g. permeability or optical density).

The copy counter, supplement counter or similar counter which has to hold the content thereof even when the main power switch of the copier is turned off may be implemented as a nonvolatile memory.

In summary, it will be seen that the present invention provides image forming equipment having various unprecedented advantages, as enumerated below.

(1) The number of times that a toner is supplemented by the operator is accurately determined since it is represented by the output of supplement detecting means.

(2) The detection of the supplement of a toner can share the same sensing element as toner end sensing, near end sensing, or toner concentration sensing (or output).

(3) Assume that whether or not a developer has been supplemented is determined on the basis of whether or not the toner concentration has increased after the detection by at least one of toner end sensing means and near end sensing means. Then, if the decision on the increase in toner concentration is made by use of a toner concentration sensed when the image forming cycle reaches a predetermined number of times after the detection, the toner concentration can be sensed in a condition wherein the toner concentration in the developing device is stabilized.

Various modifications will become possible for those skilled in the art after receiving the teachings of the present disclosure without departing from the scope thereof.

What is claimed is:

1. Image forming equipment comprising:

a developing device for developing a latent image electrostatically formed on an image carrier by a developer which comprises toner, said developing device comprising a container for storing the developer;

a cleaning device for removing developer remaining on said image carrier and collecting said developer in a collection section thereof;

supplemental detecting means for determining whether or not new developer has been supplemented to said developer storing container from outside said image forming equipment;

supplement counting means for counting the number of times that developer is supplemented to said developer storing container based on outputs from said supplement detecting means;

determining means for determining whether or not the developer collected in said collecting section has reached a predetermined level by determining whether or not developer has been supplemented to said developer storing container a predetermined number of times;

toner detecting means for detecting at an interval either one of a condition wherein said developer storing container has run out of toner or a condition wherein the toner remaining in said developer storing container is less than a predetermined amount; and image forming cycle counting means for counting the number of times that an image forming cycle is effected after said toner detecting means has detected said condition;

said supplement detecting means determining whether or not new developer has been supplemented by determining, after said toner detecting means has detected said condition, whether or not said toner detecting means detects said condition again while the image forming cycle is repeated a predetermined number of times in response to the content of said toner detecting means and the content of said image forming cycle counting means.

2. Image forming equipment comprising:

a developing device for developing a latent image electrostatically formed on an image carrier by a developer which comprises toner, said developing device comprising a container for storing the developer;

a cleaning device for removing developer remaining on said image carrier and collecting said developer in a collection section thereof;

supplemental detecting means for determining whether or not new developer has been supplemented to said developer storing container from outside said image forming equipment;

supplement counting means for counting the number of times that developer is supplemented to said developer storing container based on outputs from said supplement detecting means;

determining means for determining whether or not the developer collected in said collecting section has reached a predetermined level by determining whether or not developer has been supplemented to said developer storing container a predetermined number of times;

toner detecting means for detecting at an interval either one of a condition wherein said developer storing container has run out of toner or a condition wherein the toner remaining in said developer storing container is less than a predetermined amount;

image forming cycle counting means for counting, after said toner detecting means has detected said condition, the number of times the image forming cycle is effected while said toner detecting means does not detect said condition again; and comparing means for comparing the content of said image forming cycle counting means and a set number of times;

said supplement detecting means determining whether or not new developer has been supplemented by determining whether or not the count of said image forming cycle counting means is coincident with said set number of times on the basis of the output of said comparing means.

3. Image forming equipment comprising:

a developing device for developing a latent image electrostatically formed on an image carrier by a developer which comprises toner, said developing device comprising a container for storing the developer;

a cleaning device for removing developer remaining on said image carrier and collecting said developer in a collection section thereof;

supplemental detecting means for determining whether or not new developer has been supplemented to said developer storing container from outside said image forming equipment;

supplement counting means for counting the number of times that developer is supplemented to said developer storing container based on outputs from said supplement detecting means;

determining means for determining whether or not the developer collected in said collecting section has reached a predetermined level by determining whether or not developer has been supplemented to said developer storing container a predetermined number of times;

toner detecting means for detecting at an interval either one of a condition wherein said developer storing container has run out of toner or a condition wherein the toner remaining in said developer storing container is less than a predetermined amount;

concentration sensing means for sensing the concentration of toner in the developer stored in said developer storing container; and, decision means for determining, in response to the output of said concentration sensing means, whether or not the concentration of toner in said developer has increased after said toner detecting means has detected said condition;

said supplement detecting means determining whether or not new developer has been supplemented on the basis of the output of said decision means.

4. Image forming equipment as claimed in claim 3, wherein said decision means comprises:

store means for storing, when said toner detecting means has detected said condition, the concentration of toner in the developer having been sensed by said concentration sensing means;

image forming cycle counting means for counting the number of times the image forming cycle is effected after said toner detecting means has detected said condition; and comparing means for comparing the concentration of toner in the developer sensed when the count of said image forming cycle counting means coincides with a predetermined number of times with said concentration stored in said store means.

5. Image forming equipment comprising:

a developing device for developing a latent image electrostatically formed on an image carrier by a developer which comprises toner, said developing device comprising a container for storing the developer;

a cleaning device for removing developer remaining on said image carrier and collecting said developer in a collection section thereof;

supplemental detecting means for determining whether or not new developer has been supplemented to said developer storing container from outside said image forming equipment;

supplement counting means for counting the number of times that developer is supplemented to said developer storing container based on outputs from said supplement detecting means;

determining means for determining whether or not the developer collected in said collecting section has reached a predetermined level by determining whether or not developer has been supplemented to said developer storing container a predetermined number of times;

near end detecting means for detecting a condition wherein the amount of toner remaining in said developer storing container is less than predetermined amount;

first alerting means driven in response to the output of said near end detecting means;

second alerting means driven in response to the output of said near end detecting means;

toner end detecting means for detecting a condition wherein said developer storing container has run out of toner;

image forming cycle counting means for counting, after said near end detecting means has determined that the amount of toner is less than a predetermined amount, the number of times that the image forming cycle is effected while said toner end detecting means does not determine that said developer storing container has run out of toner; and comparing means for comparing the content of said image forming cycle counting means with a set number of times;

said supplement detecting means determining whether or not new developer has been supplemented in response to the output of said comparing means.

* * * * *